US007002286B2

(12) United States Patent
Kim et al.

(10) Patent No.: US 7,002,286 B2
(45) Date of Patent: Feb. 21, 2006

(54) SHADOW MASK FRAME ASSEMBLY WITH ETCHING PORTION AND COLOR CATHODE-RAY TUBE HAVING THE SAME

(75) Inventors: Chan-woo Kim, Seoul (KR); Sang-hyun Eom, Seoul (KR)

(73) Assignee: Samsung SDI Co., Ltd., Suwon-si (KR)

( * ) Notice: Subject to any disclaimer, the term of this patent is extended or adjusted under 35 U.S.C. 154(b) by 166 days.

(21) Appl. No.: 10/349,040

(22) Filed: Jan. 23, 2003

(65) Prior Publication Data

US 2003/0137231 A1 Jul. 24, 2003

(30) Foreign Application Priority Data

Jan. 23, 2002 (KR) ..... 2002-3864

(51) Int. Cl.
*H01J 29/80* (2006.01)

(52) U.S. Cl. ..... 313/407; 313/408

(58) Field of Classification Search ..... 313/402–408
See application file for complete search history.

(56) References Cited

U.S. PATENT DOCUMENTS

| | | | | |
|---|---|---|---|---|
| 3,585,431 | A * | 6/1971 | Long | 313/407 |
| 4,094,678 | A | 6/1978 | Palac | 96/36.1 |
| 4,173,729 | A * | 11/1979 | Stone et al. | 313/403 |
| 4,210,843 | A | 7/1980 | Avadani | 313/403 |
| 4,437,036 | A * | 3/1984 | Ragland, Jr. | 313/402 |
| 5,189,334 | A * | 2/1993 | Park | 313/402 |
| 6,111,346 | A * | 8/2000 | Ito et al. | 313/402 |
| 6,222,309 | B1 * | 4/2001 | Taga et al. | 313/402 |
| 6,255,765 | B1 * | 7/2001 | Ito et al. | 313/402 |
| 6,259,194 | B1 * | 7/2001 | Ito et al. | 313/408 |
| 6,274,974 | B1 * | 8/2001 | Ito et al. | 313/402 |
| 6,384,522 | B1 * | 5/2002 | Tani et al. | 313/402 |
| 6,710,532 | B1 * | 3/2004 | Choi | 313/414 |
| 2001/0007408 | A1 * | 7/2001 | Furusawa et al. | 313/407 |
| 2001/0052745 | A1 * | 12/2001 | Murai et al. | 313/402 |
| 2002/0011772 | A1 * | 1/2002 | Ito et al. | 313/407 |

FOREIGN PATENT DOCUMENTS

| | | | |
|---|---|---|---|
| JP | 57-105946 | 1/1982 | |
| JP | 60232642 | * 11/1985 | 313/407 |
| JP | 1-197942 | 9/1989 | |
| JP | 8-298078 | 12/1996 | |

* cited by examiner

*Primary Examiner*—Mariceli Santiago
*Assistant Examiner*—Elizabeth Rielley
(74) *Attorney, Agent, or Firm*—Stein, McEwen & Bui, LLP

(57) ABSTRACT

A color cathode-ray tube includes a panel having a fluorescent screen on its inside, a funnel which is coupled to the panel and has a cone portion at which a deflection yoke is installed, an electron gun which is installed in a neck portion of the funnel, and a shadow mask frame assembly which is installed at the inside of the panel and includes a shadow mask and a frame. The shadow mask includes an apertured portion which has a plurality of electron beam passage holes, an imperforate portion which extends from and surrounds a periphery of the apertured portion, and a skirt portion which is bent from a periphery of the imperforate portion and has a plurality of etched portions and embossments that are formed in the skirt portion. The frame is partially welded to the skirt portion of the shadow mask to support the shadow mask.

38 Claims, 15 Drawing Sheets

SHADOW MASK FRAME ASSEMBLY WITH ETCHING PORTION AND COLOR CATHODE-RAY TUBE HAVING THE SAME

CROSS-REFERENCE TO RELATED APPLICATIONS

This application claims the benefit of Korean Application No. 02-3864, filed Jan. 23, 2002, in the Korean Intellectual Property Office, the disclosure of which is incorporated herein by reference.

BACKGROUND OF THE INVENTION

1. Field of the Invention

The present invention relates to a color cathode ray tube, and more particularly, to a shadow mask frame assembly which is installed near a fluorescent screen on the inside of a panel of a color cathode-ray tube (CRT) and performs a color selection function, and a CRT having the same.

2. Description of the Related Art

FIG. 1 shows an example of a typical color CRT used for computer monitors and televisions. Referring to FIG. 1, the color CRT includes a panel 10 which has a fluorescent screen 11 on an inside surface of the CRT, a funnel 20 which is sealed to the panel 10 and has a neck portion 21 in which an electron gun 22 is installed, a deflection yoke 23 which is installed at a cone portion of the funnel 20, and a shadow mask frame assembly 30 including a shadow mask 31 which is separated from the fluorescent screen 11 by a predetermined distance. The shadow mask assembly 30 has a color selection function with respect to electron beams emitted from the electron gun 22 and a frame 39 which supports the shadow mask 31.

In a color CRT having the structure described above, electron beams emitted from the electron gun 22 are deflected by the deflection yoke 23, pass through electron beam passage holes formed in the shadow mask 31, and strike red, green, and blue fluorescent materials of the fluorescent screen 11 to excite the fluorescent materials, thereby forming an image.

In the above-described operation, if the electron beam passage holes in the shadow mask 31 move from a specific position relative to the screen 11, electron beams cannot precisely strike the corresponding fluorescent materials. Accordingly, it is necessary to prevent the structural change or misalignment of the electron beam passage holes while manufacturing the shadow mask frame assembly 30, to maintain optimal color selection for a distinctive image.

As shown in FIG. 2, the shadow mask 31 is formed by press-molding a thin film having a plurality of holes in a predetermined area. The shadow mask 31 includes an apertured portion 32 with a plurality of electron beam passage holes, an imperforate portion 33 extending from the edge of the apertured portion 32, and a skirt portion 34 which is vertically bent down from the imperforate portion 33. The shadow mask 30 is made of killed steel or invar and thus is not easily molded. Particularly, the skirt portion 34, which is bent at a right angle to the imperforate portion 33, flexes back toward a flat position due to a spring-back phenomenon. Thus, the inherent elasticity of the material inclines the skirt portion 34 away from the center of the shadow mask 31.

The shadow mask 31 is fixed to the frame 39 by pressing the skirt portion 34 inward and inserting the skirt portion 34 behind the frame 39. The shadow mask then is welded to the frame 39. When the skirt portion 33 of the shadow mask 31 is pressed inward in the direction D shown by the arrow in FIG. 2, a bending stress causes changes in the imperforate portion 33 and the apertured portion. Since the apertured portion 32 is weakened due to the electron beam holes, the apertured portion 32 may flex and experience a curvature, as shown in path A of FIG. 2. While the curvature may not be visibly noticeable, it can displace electron beam passage holes at the periphery of the apertured portion 32 from originally set positions. Consequently, in a color CRT using this shadow mask 31, electron beams passing through the electron beam passage holes may not strike the fluorescent screen in the correct locations due to misalignment, thereby degrading the white balance characteristic of an image.

The structure of a color shadow mask for overcoming the above-described problem is disclosed in U.S. Pat. Nos. 6,111,346 and 6,274,974 B1. As shown in FIGS. 3A through 4B, a shadow mask 40 includes a curved apertured portion 41 having a plurality of electron-transmissive apertures, an imperforate portion 42 surrounding the curved aperture portion 41, and a skirt portion 43 which is bent back from a periphery of the imperforate portion 42 at long and short sides. The skirt portion 43 is spot-welded to a frame (not shown) so that the shadow mask 40 can be supported by the frame. The skirt portion 43 includes a plurality of slits 44 and embossments 45 which extend in a direction of a height of the skirt portion 43.

This conventional shadow mask 40 has a plurality of embossments 45 and slits 44 in the skirt portion 43 so that the spring-back phenomenon of the skirt portion 43 can be prevented during manufacturing of the shadow mask 40. However, as shown in FIG. 5, since the contour of the skirt portion 43 is complicated due to the plurality of slits 44, it is not easy to insert the skirt portion 43 into a frame 47. In addition, the slits 44 may be distorted by damage from a carrier during manufacturing. Moreover, formation of the slits 44 produces many cut-away pieces, which can contaminate products.

Another shadow mask is disclosed in Japanese Patent Publication No. 57-105946. The shadow mask includes a half etched portion in which a skirt portion is formed using etched and a half non-etched portion surrounding the half etched portion (not shown).

A structure in which embossments are formed in a skirt portion of a shadow mask in the height direction of the skirt portion is disclosed in Japanese Patent Publication No. 1-197,942.

A structure in which holes such as slits are formed in a skirt portion of a shadow mask is disclosed in Japanese Patent Publication No. 8-298,078.

Methods of manufacturing a mask are disclosed in U.S. Pat. Nos. 4,094,678 and 4,210,843.

SUMMARY OF THE INVENTION

To solve the above-described and/or other problems, it is an aspect of the present invention to provide a shadow mask frame assembly with increased plasticity to prevent a curvature at a periphery of the shadow mask and to prevent misalignment or transformation of electron beam passage holes when the shadow mask is welded to a frame.

Another aspect of the present invention is to provide a shadow mask frame assembly for a color CRT with increased continuity around the perimeter of the skirt portion, thereby reducing defects which can occur when the shadow mask is welded to the frame and increasing the impact strength of the assembly.

A third aspect of the present invention provides a color CRT using the shadow mask frame assembly.

Additional aspects and advantages of the invention are set forth and/or will be obvious partly from the following description or may be learned by practice of the invention.

To achieve aspects of the present invention, a shadow mask frame assembly for a color CRT includes a shadow mask and a frame. The shadow mask includes an apertured portion which has a plurality of electron beam passage holes, an imperforate portion which extends from and surrounds a periphery of the apertured portion, and a skirt portion which is bent from a periphery of the imperforate portion and has a plurality of etched portions and embossments. The frame is partially welded to the skirt portion of the shadow mask to support the shadow mask.

The etched portions may be formed by etching the inside and/or the outside of the skirt portion. Each of the etched portions may comprise grooves which are formed by etching the inside and outside of the skirt portion at predetermined intervals. In one aspect, the etched portions are formed by etching the skirt portion to a depth of 50–90% of the thickness of the skirt portion and to a height of between 70% to 100% of the height of the skirt portion.

The skirt portion formed at the long and short sides of the shadow mask include a welding portion centered on each side. The welding portion may include a slot which is formed in the direction of the skirt portion's height starting from the bottom end of the skirt portion at the center thereof and etched portions which are formed at both sides of the slot. The welding portion also may include auxiliary etched portions that are formed on the outside and/or the inside of the skirt portion along the length of the skirt portion to define grooves extending between the etched portions.

To achieve another aspect of the present invention, a shadow mask frame assembly for a color CRT includes a shadow mask and a frame. The shadow mask includes an apertured portion which has a plurality of electron beam passage holes, an imperforate portion which extends from and surrounds a periphery of the apertured portion, and a skirt portion which is bent from a periphery of the imperforate portion at long and short sides of the imperforate portion and has a plurality of embossments that are formed in the in the direction of the skirt portion height and a plurality of etched portions that are formed along the length of the skirt portion. The frame is partially welded to the skirt portion of the shadow mask to support the shadow mask.

To achieve a further aspect of the present invention, a color CRT includes a panel with a fluorescent screen inside the CRT, a funnel that is coupled to the panel, and a cone portion where a deflection yoke is installed, an electron gun which is installed in a neck portion of the funnel, and a shadow mask frame assembly installed between the panel and the electron gun that includes a shadow mask and a frame. The shadow mask includes an apertured portion with a plurality of electron beam passage holes, an imperforate portion which extends from and surrounds a periphery of the apertured portion, and a skirt portion which is bent from a periphery of the imperforate portion and has a plurality of etched portions and embossments that are formed in the direction of the skirt portion height. The frame is partially welded to the skirt portion of the shadow mask to support the shadow mask.

BRIEF DESCRIPTION OF THE DRAWINGS

These and/or other aspects and advantages of the present invention will become more apparent and appreciated from the embodiments described below and the accompanying drawings in which.

DETAILED DESCRIPTION OF THE PREFERRED EMBODIMENTS

Figure 1:
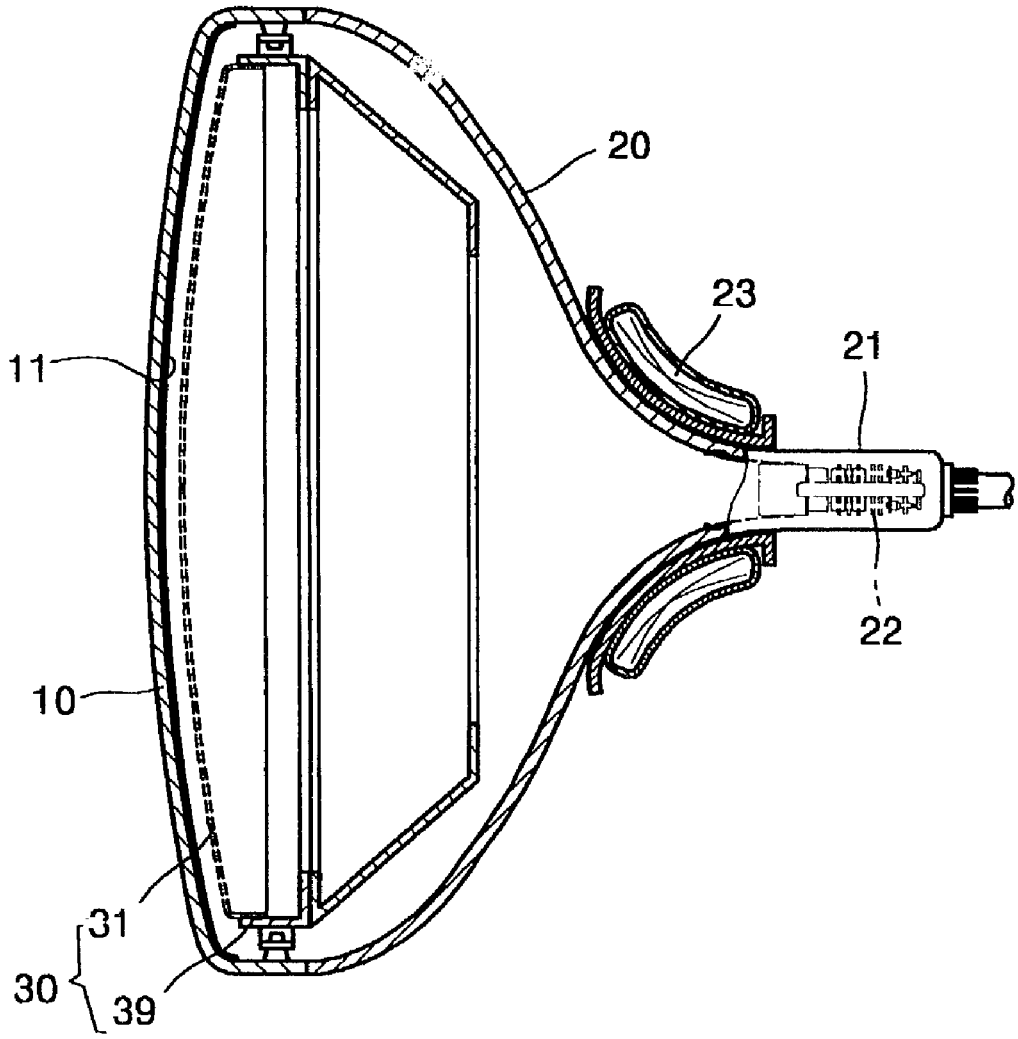
FIG. 1 (PRIOR ART)
FIG. 1 is a sectional view of a conventional cathode-ray tube (CRT)
Figure 2:
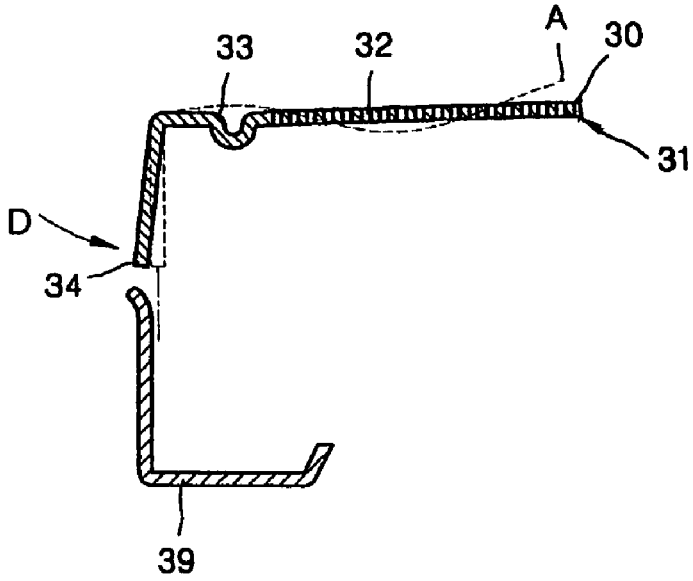
FIG. 2 (PRIOR ART)
FIG. 2 is a sectional view of a conventional shadow mask frame assembly, which shows a skirt portion of a shadow mask and transformation of the shadow mask.
Figure 3A:
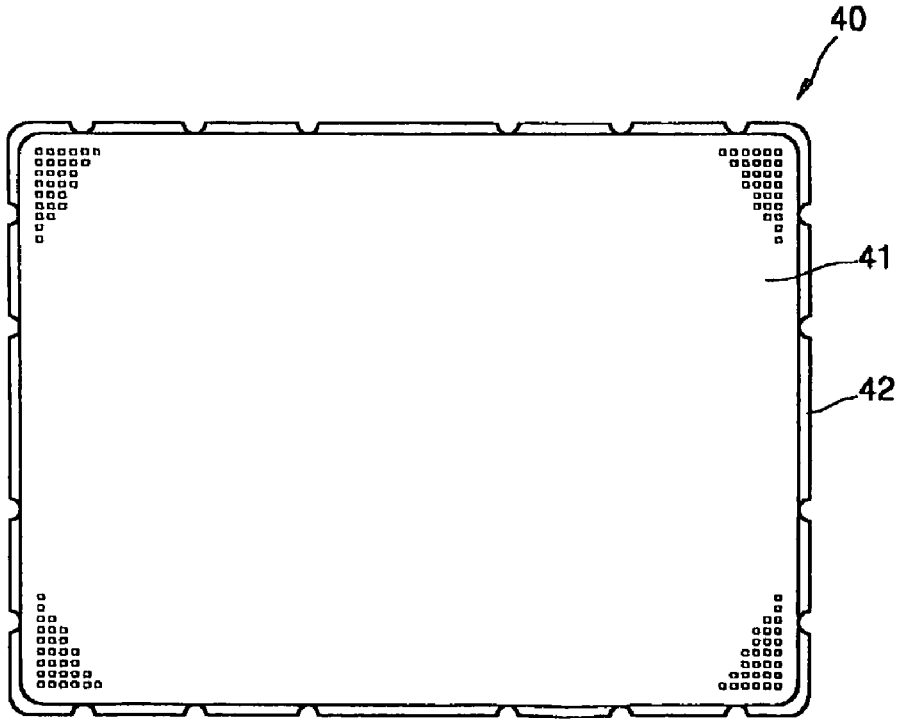
FIG. 3A (PRIOR ART)
FIG. 3A is a plan view of a conventional shadow mask.
Figure 3B:
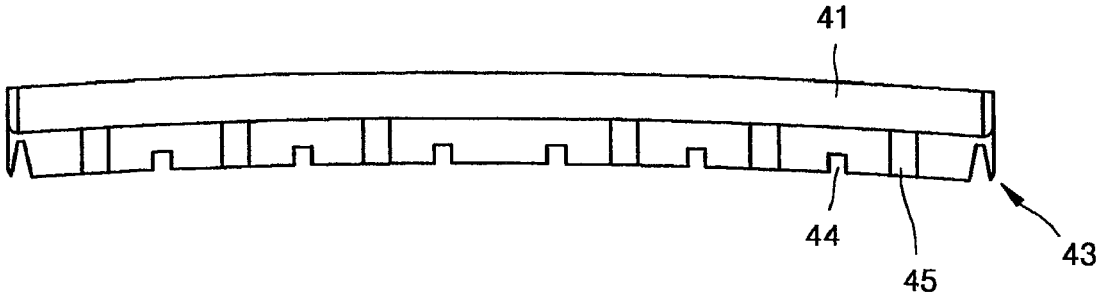
FIG. 3B (PRIOR ART)
FIG. 3B is a side view of a conventional shadow mask.
Figure 4A:
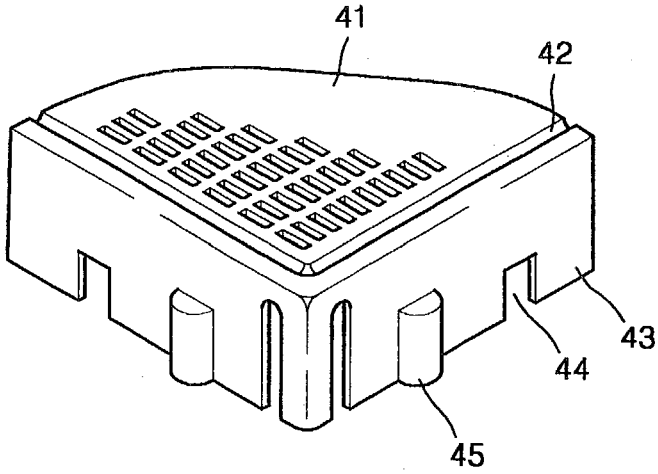
FIG. 4A (PRIOR ART)
FIGS. 4A and 4B are fragmentary perspective views of conventional shadow masks.
Figure 4B:
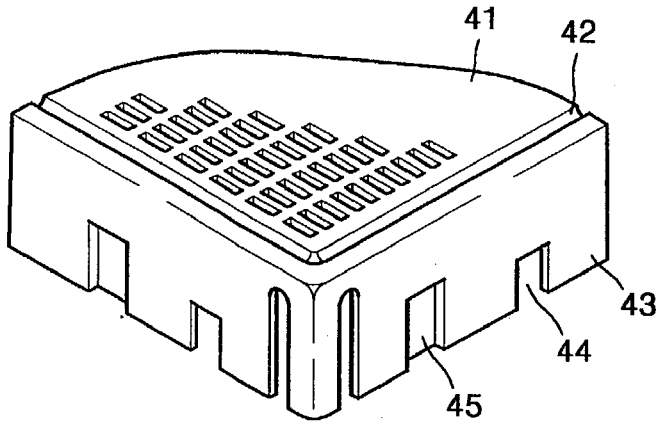
FIG. 4B (PRIOR ART)
Figure 5:
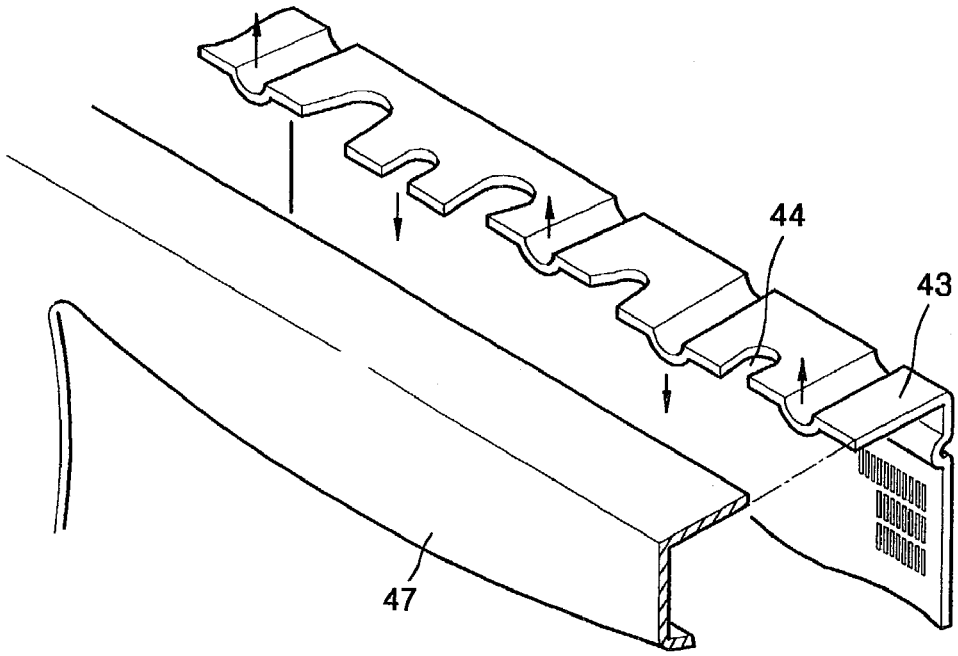
FIG. 5 (PRIOR ART)
FIG. 5 is a perspective view showing a conventional shadow mask welded to a frame.

Detailed embodiments of the present invention are described below with examples illustrated in the accompanying drawings. Reference numerals refer to like elements throughout the specification and the drawings.

Figure 6:
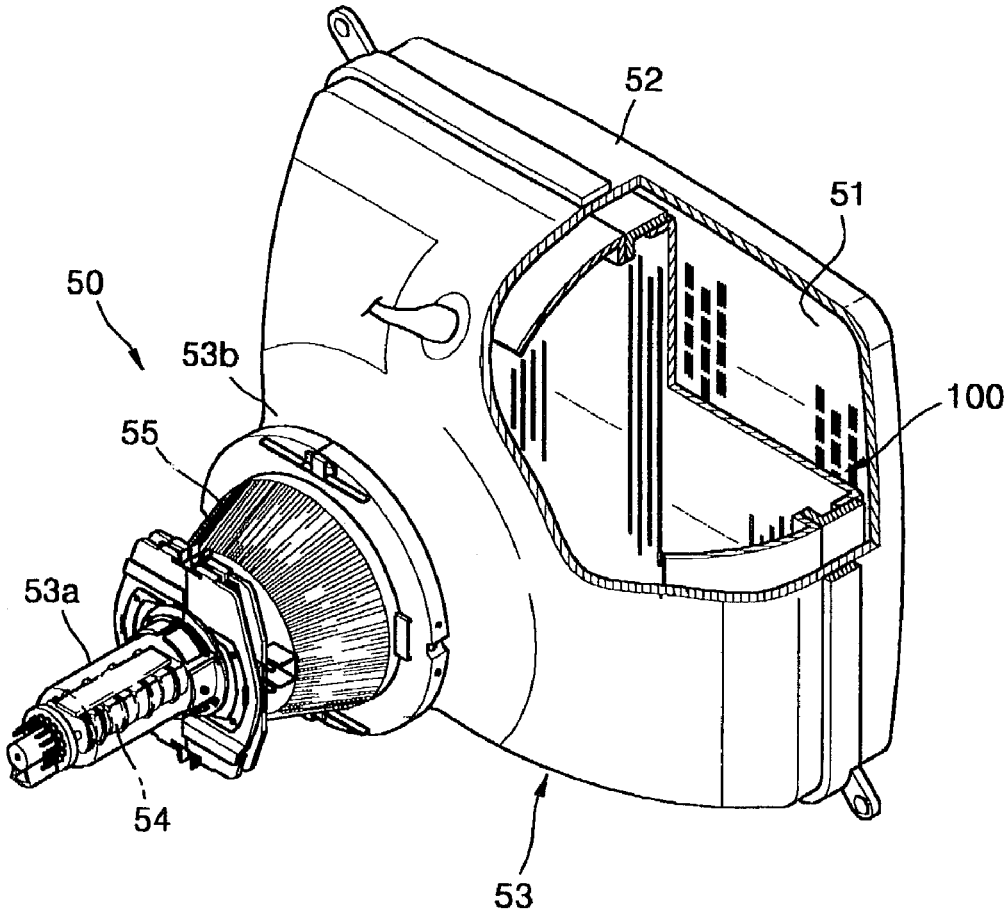
FIG. 6 is a partially cutaway perspective view of a color CRT according to an embodiment of the present invention.

FIG. 6 shows an embodiment of a CRT 50 using a shadow mask frame assembly according to the present invention. As shown in FIG. 6, the CRT 50 includes a panel 52 which has a fluorescent screen 51 formed in a predetermined pattern on the inside surface of the panel 52 and a shadow mask frame assembly 100 which is installed near the inside surface of the panel 52 in order to exactly guide three types of electron beams onto fluorescent material layers of the fluorescent screen 51. The panel 52 is sealed to a funnel 53. The funnel includes a neck portion 53*a* and a cone portion 53*b*. An electron gun 54 is positioned within the neck portion 53*a*. A deflection yoke 55 deflects electron beams emitted from the electron gun 54 to guide them onto various locations on the fluorescent material layers. The deflection yoke 55 surrounds the CRT 50 between the neck portion 53*a* and the cone portion 53*b*.

Figure 7:
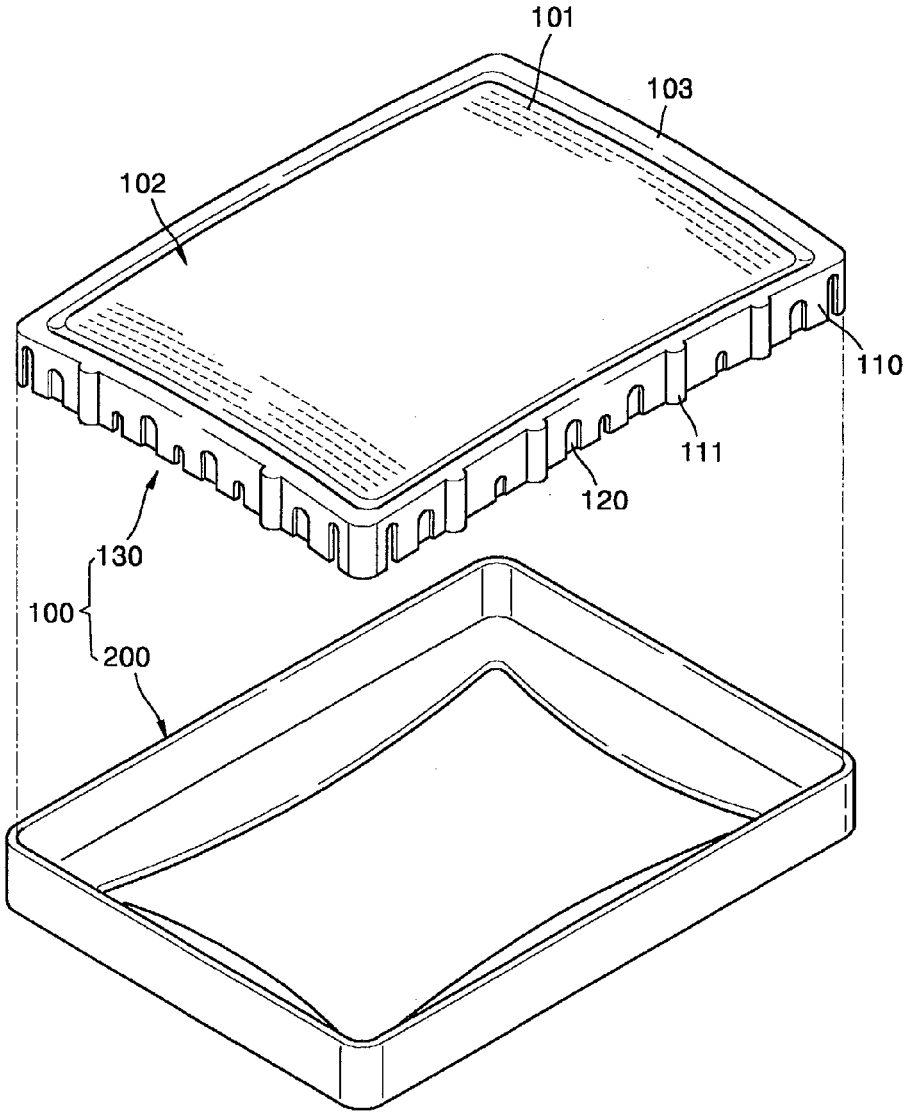
FIG. 7 is an exploded perspective view of a shadow mask frame assembly according to the present invention.

FIG. 7 shows an embodiment of the shadow mask frame assembly 100 for exactly guiding three electron beams onto red, green, and blue fluorescent material layers on the fluorescent screen 51 in the CRT 50 (shown in FIG. 6). The fluorescent materials become excited by contact with the electron beam, thereby emitting colored light.

Referring to FIG. 7, the shadow mask frame assembly 100 includes a shadow mask 130 and a frame 200. The shadow mask 130 is formed of a thin film and includes an apertured portion 102 which has a plurality of electron beam passage holes 101 and a predetermined curvature, an imperforate portion 103 which extends from and surrounds the periphery of the apertured portion 102, and a skirt portion 110 which is bent from the periphery of the imperforate portion 103 at long and short sides in a direction of the axis of the CRT 50. The frame 200 is spot-welded to the skirt portion 110 of the shadow mask 130 to support the shadow mask 130 and is suspended inside the CRT 50 next to the panel 52 such that the shadow mask 130 is separated from the fluorescent screen 51 by a predetermined distance.

A plurality of embossments 111 and etched portions 120 are formed in the skirt portion 110 of the shadow mask 130 along the height of the skirt portion 110. Since the embossments 111 are formed while upper and lower metal molds (not shown) move together in a process of molding a thin film for the shadow mask 130, as shown more clearly in FIG. 10, the embossments 111 are usually formed to have a length which is the same as the height $H_1$ of the skirt portion 110 but are not restricted thereto. The embossments 111 may be formed to have a height greater than 70% of the height H1 of the skirt portion 110 starting from the border between the skirt portion 110 and the imperforate portion 103 or the bottom end of the skirt portion 110. In the embodiments of the present invention, the height H, of the skirt portion 110 is 9–16 mm, the embossments 111 have a width L1 of 1–5 mm and have a maximum height BH of 9–16 mm or greater than 5–14 mm.

Figure 8:
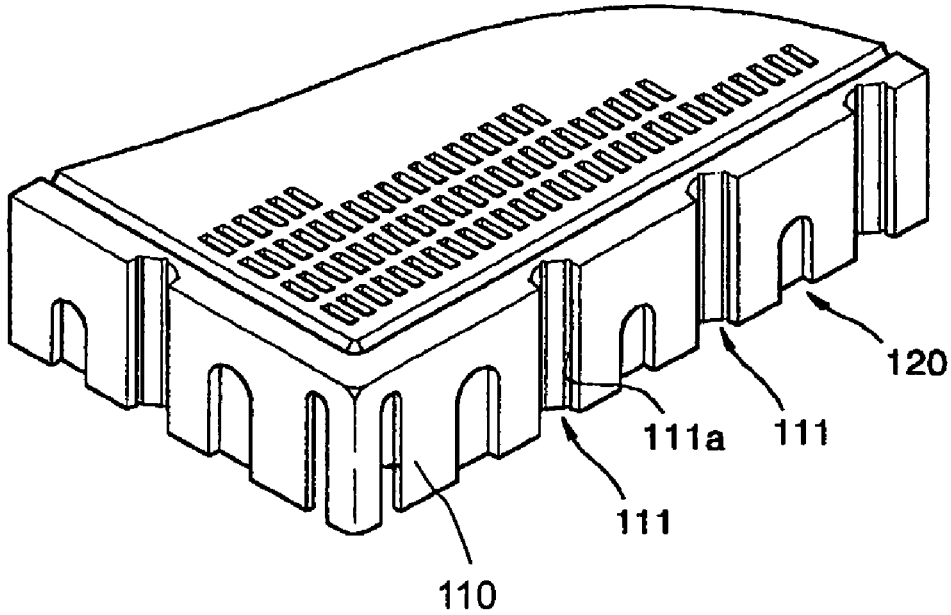
FIGS. 8 and 9 are fragmentary perspective views of embodiments of a shadow mask according to the present invention.
Figure 9:
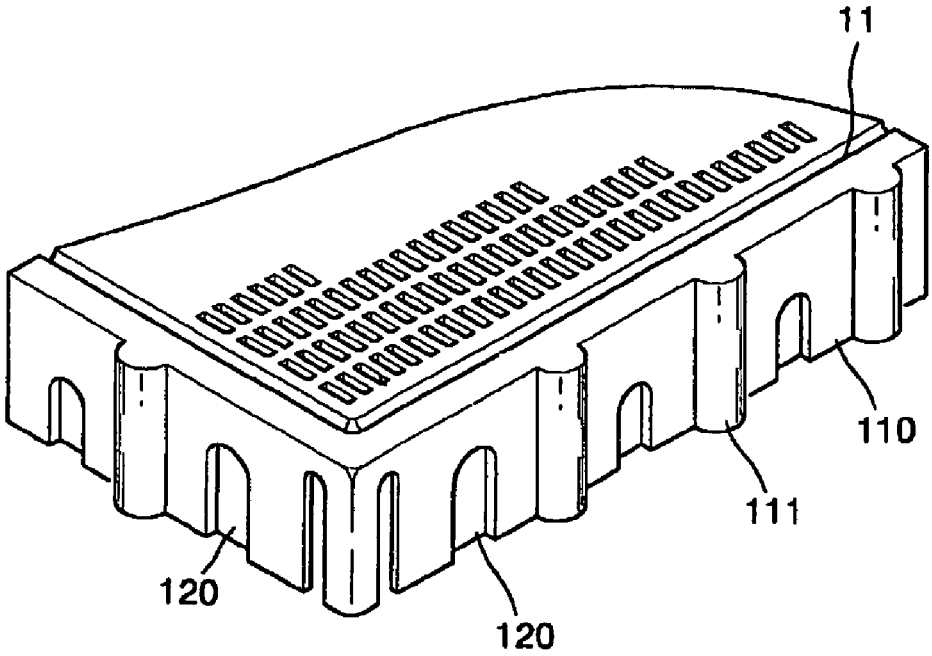

As shown in FIGS. 8 and 9, the embossments 111 protrude outward and inward along the skirt portion 110. The embossments 111 can be formed in various shapes, such as, a part of a cylinder, a part of a polygonal prism, and a part of a polygonal pyramid, taking into account the design conditions or the spring-back elasticity after molding. As shown in the embodiment of the invention in FIG. 8, the local etched portion 111*a* also may be formed in the inside or outside of each embossment 111, or need not be included as shown in FIG. 9.

Figure 10:
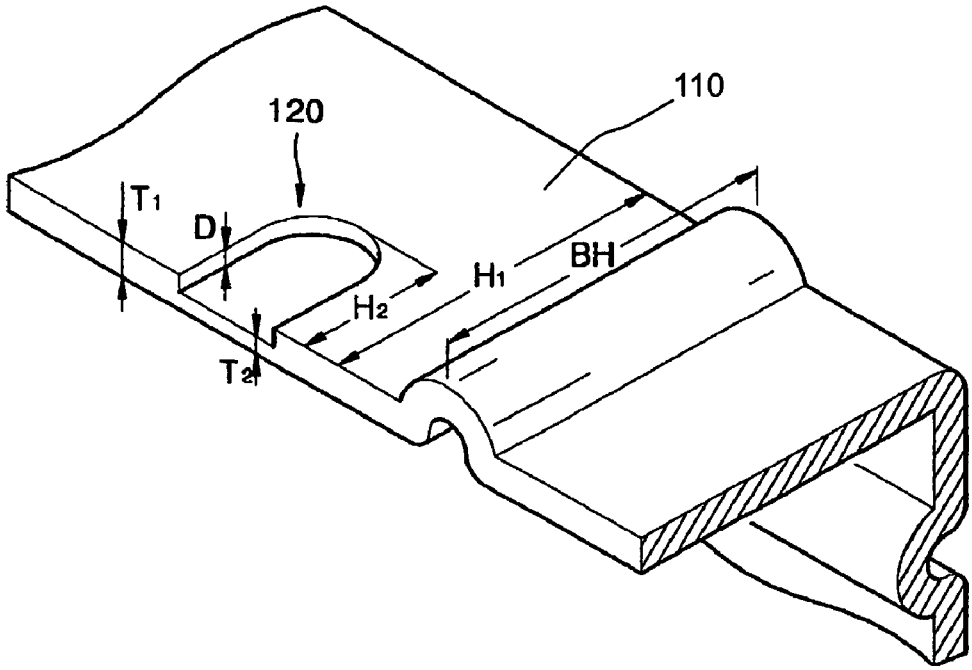
FIG. 10 is a partial perspective view of an embodiment of an etched portion formed in a skirt portion of a shadow mask according to the present invention.

As shown in FIG. 10, each etched portion 120 of the skirt portion 110 is formed by etching one side of the skirt portion to a thickness $T_2$ thinner than the thickness $T_1$ of the skirt portion 110 when etching a thin film to form the shadow mask 130. The etched depth D of the etched portion 120 typically is 50–90% of the thickness $T_1$ of the skirt portion 110. Although the height $H_2$ of the etched portion 120 is not restricted, it is preferably less than 70% of the height $H_1$ of the skirt portion 110, taking into account the structural strength of the skirt portion 110 and the degree of transformation of the skirt portion 110 when the skirt portion 110 is welded to the frame 200 (shown in FIG. 16). In the embodiments of the present invention, the etched portion 120 has a width $L_4$ of 3–15 mm and a height $H_2$ of 3–14 mm.

Figure 11:
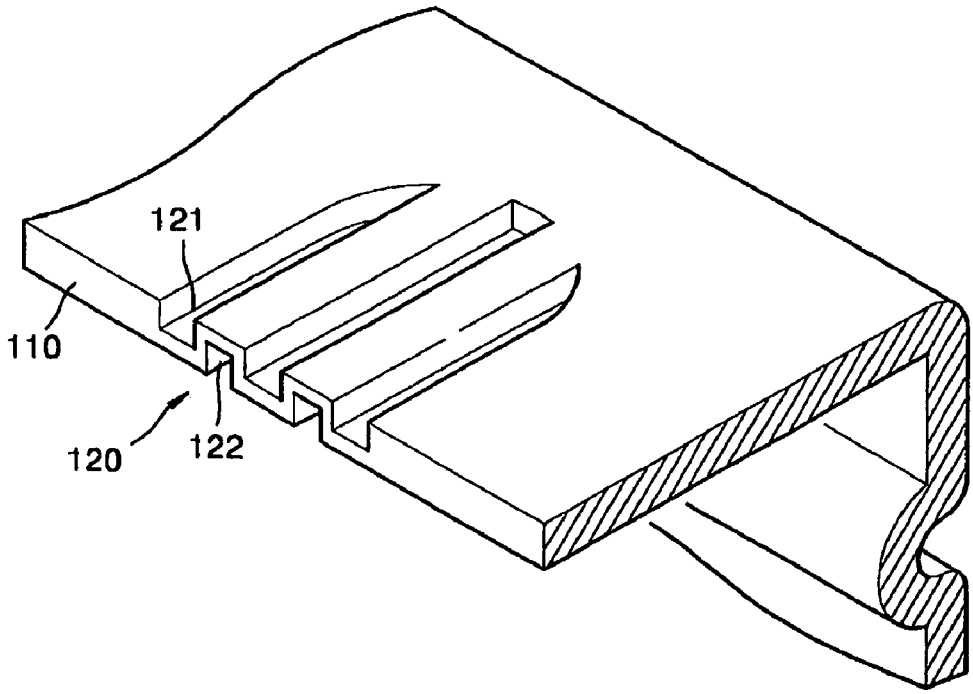
FIGS. 11 through 13 are partial perspective views of other embodiments of an etched portion formed in a skirt portion of a shadow mask according to the present invention.
Figure 12:
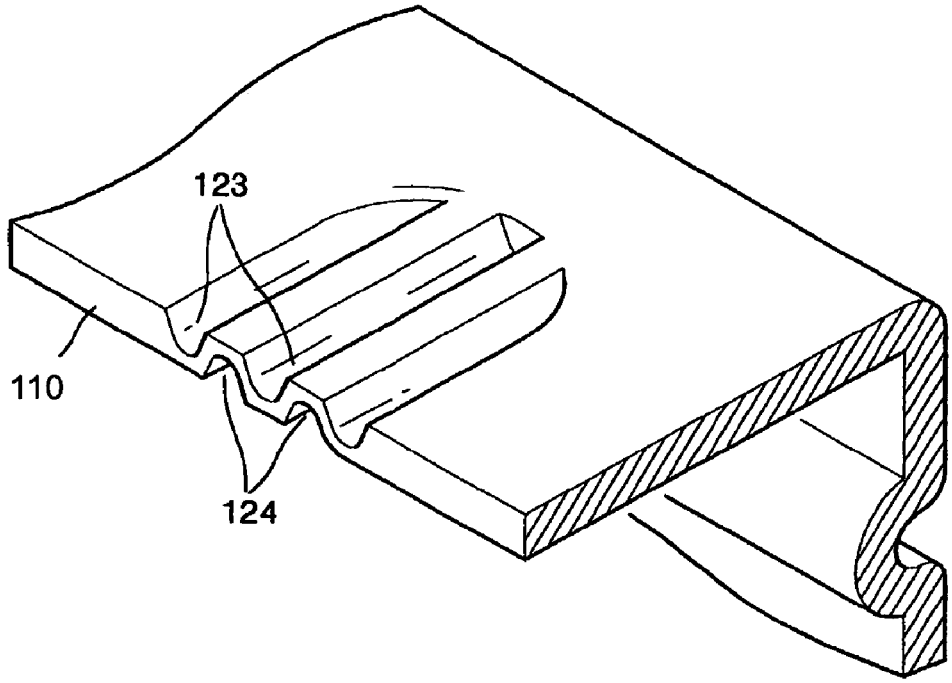
Figure 13:
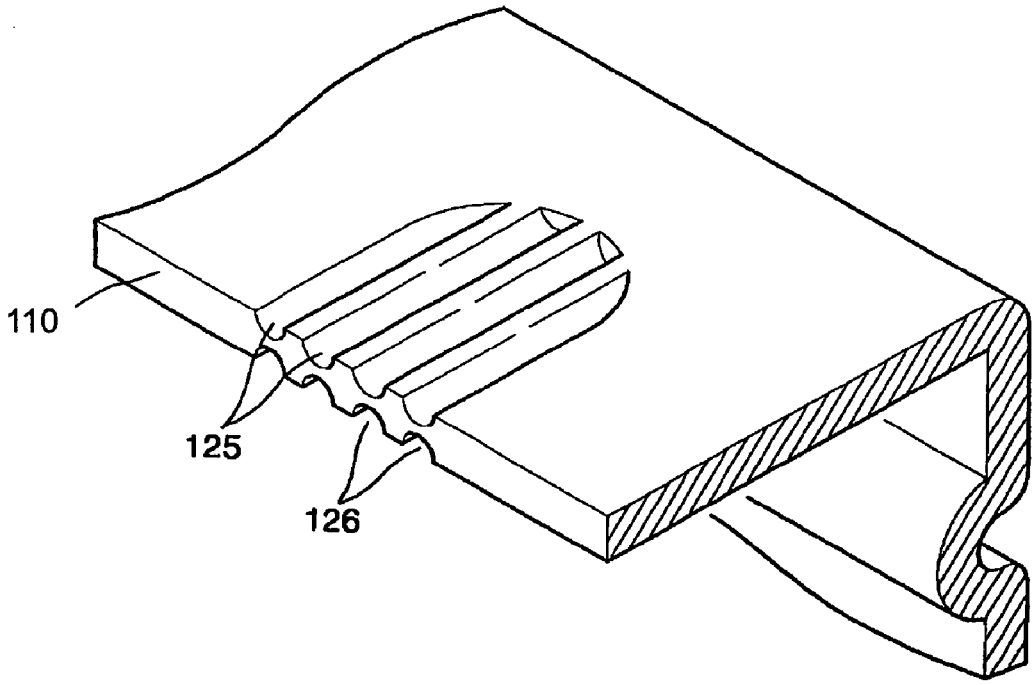

In another embodiment, the etched portions 120 of the skirt portion 110 may be formed by partially etching the inside and outside of the skirt portion 110 to a predetermined depth. In other embodiments, as shown in FIGS. 11 and 12, alternate grooves 121 and 122 and alternate grooves 123 and 124 may form the etched portions 120 by partially etching the inside and outside of the skirt portion 110 at predetermined intervals. In still another embodiment, as shown in FIG. 13, grooves 125 and 126 that correspond to each other may be formed on the inside and outside of the skirt portion 110. The structure of the etched portions 120 is not restricted to the above embodiments, but any structure which can prevent the spring-back of the skirt portion 110 with respect to an imperforate portion and an apertured portion during molding of a shadow mask and which can absorb a stress along the length and height of the skirt portion 110 can be used.

Figure 14:
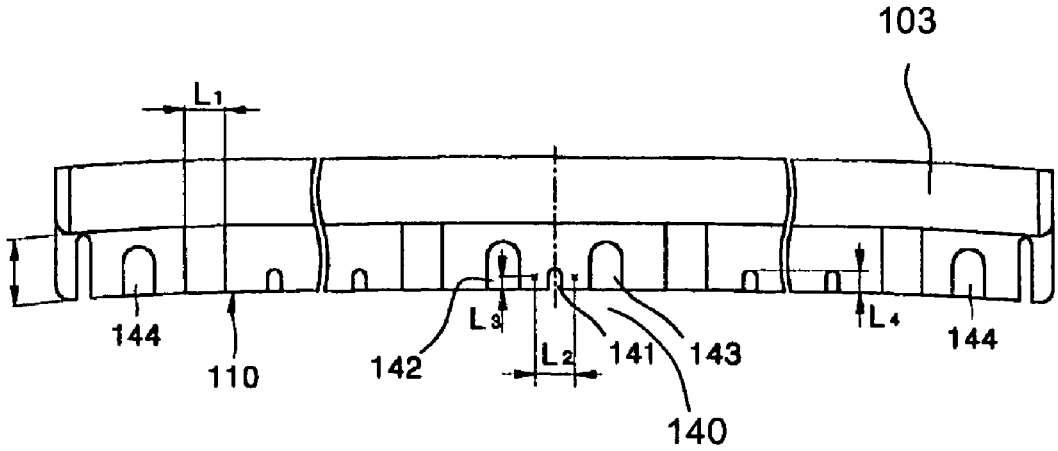
FIG. 14 is a side view of a shadow mask according to the present invention.
Figure 15:
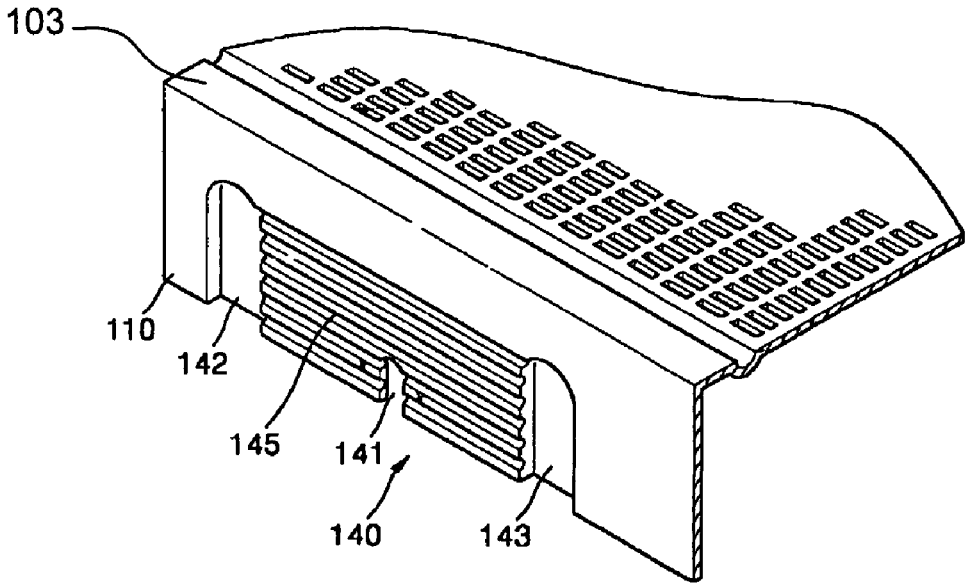
FIG. 15 is a perspective view of a welding portion of the shadow mask shown in FIG. 14.

FIG. 14 is a side view of an embodiment of a long side of the skirt portion 110 of the shadow mask, and FIG. 15 shows an embodiment of a welding portion 140 that is positioned at the middle of the skirt portion shown in FIG. 14.

Referring to FIGS. 14 and 15, the welding portion 140 has a slot 141 which extends from the bottom end of the skirt portion 110 toward the imperforate portion 103 and first and second etched portions 142 and 143 which are formed on each side of the slot 141 and separated from the slot 141 by a predetermined distance. In one embodiment, the height of the slot 141 does not exceed 50% of the height of the skirt portion 110. As shown in FIG. 14 the first and second etched portions 142 and 143 and etched portions 144 at both ends of the skirt portion 110 may be wider and higher than the other etched portions 120.

Figure 16:
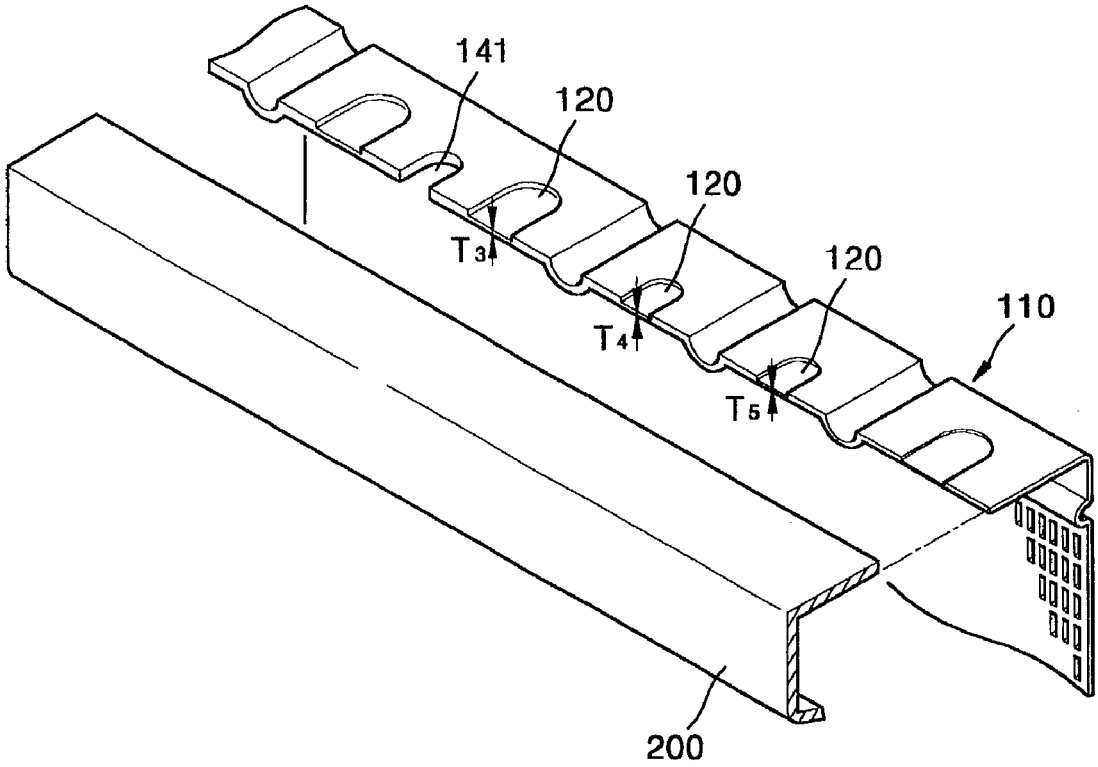
FIG. 16 is a perspective view of an embodiment of a skirt portion of a shadow mask according to the present invention.

As shown in FIG. 16, the etched portions 120 arranged in the skirt portion 110 have different thicknesses at different positions along the skirt portion and may have gradually decreasing thicknesses $T_3$, $T_4$, and $T_5$ from the center of the skirt portion 110 toward the periphery. The present invention is not restricted to the above embodiment. For example, one etched portion 120 at the outermost portions at both ends of the skirt portion 110 may be etched more deeply, and thus may be thinner than the other etched portions 120.

Figure 17:
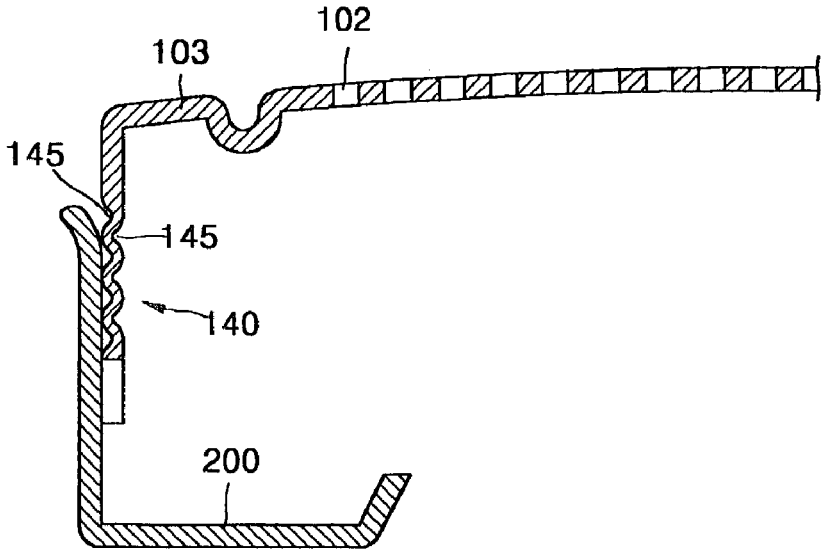
FIG. 17 is a sectional view showing the welding portion shown in FIG. 15 welded to a frame.

As shown in FIGS. 15 and 17, auxiliary etched portions 145 are formed lengthwise in the skirt portion 110. As shown in FIG. 15, the auxiliary etched portions 145 are between first and second etched portions 142 and 143 to define grooves extending between the first and second etched portions 142, 143. The auxiliary etched portions 145 are not restricted to the structures shown in FIGS. 15 and 17. Any structure which can reduce transmissivity of the stress on the welding portion 140 to the apertured portion 102 and the imperforate portion 103 during welding between the frame 200 and the skirt portion 110 can be used.

Referring to FIG. 14, the welding portion 140 is welded to the frame 200 (shown in FIG. 16) at welding spots on each side of the slot 141 and between the first etched portion 142 and the second etched portion 143 at a height $L_3$ of 0.5–5 mm from the bottom end of the skirt portion 110. In one implementation, the distance $L_2$ between the two weld spots is 10–40 mm.

Figure 18:
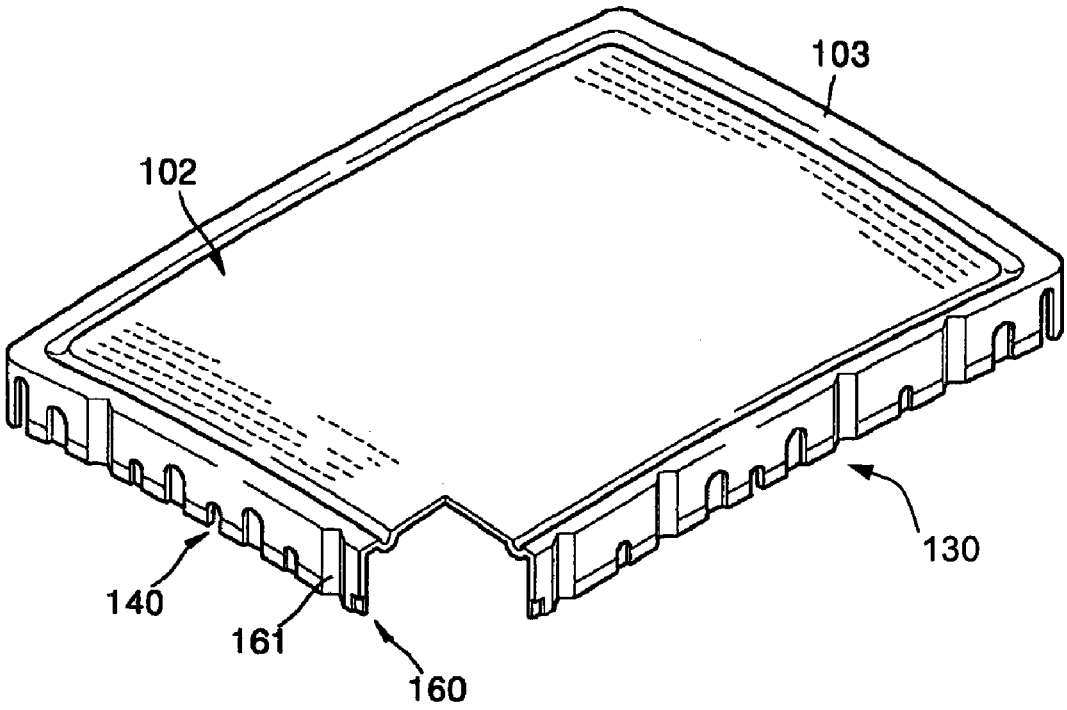
FIG. 18 is a partially cutaway perspective view of another embodiment of a shadow mask according to the present invention.

FIG. 18 shows another embodiment of a shadow mask according to the present invention.

Figure 19:
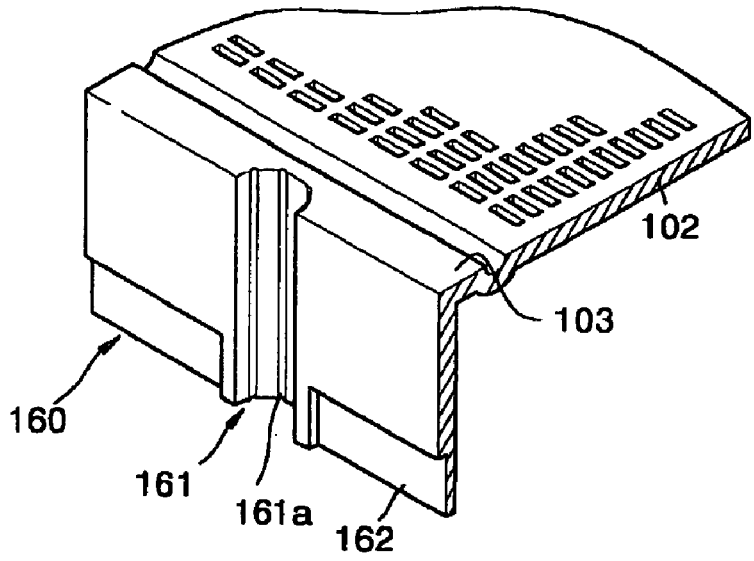
FIG. 19 is a fragmentary perspective view of the shadow mask shown in FIG. 18.
Figure 20:
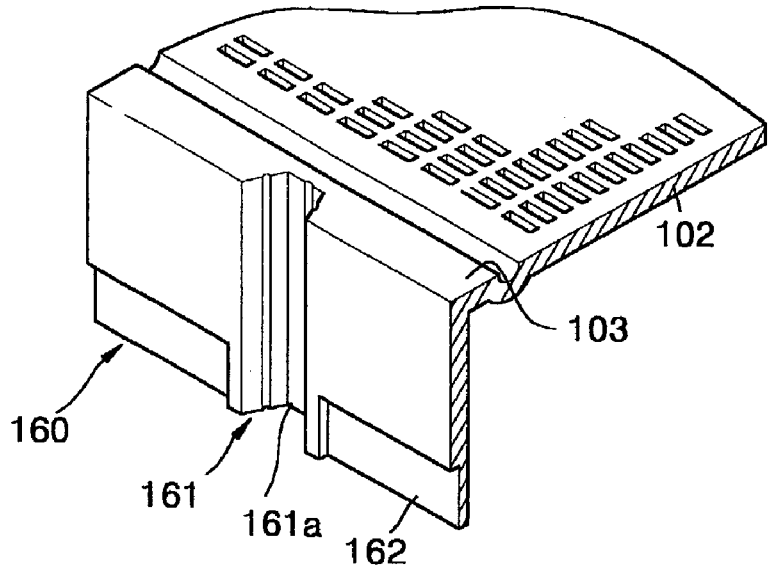
FIGS. 20 through 22 are fragmentary perspective views of other embodiments of a skirt portion according to the present invention.

Embossments 161 and etched portions 162 are formed in a skirt portion 160 which is bent from an imperforate portion 103 of a shadow mask 130. As shown in FIGS. 19 and 20, each embossment 161 has a shape forming a part of a cylinder or a polygonal prism. Auxiliary etched portions 161*a* are formed on the inside or outside of each embossment 161.

Figure 21:
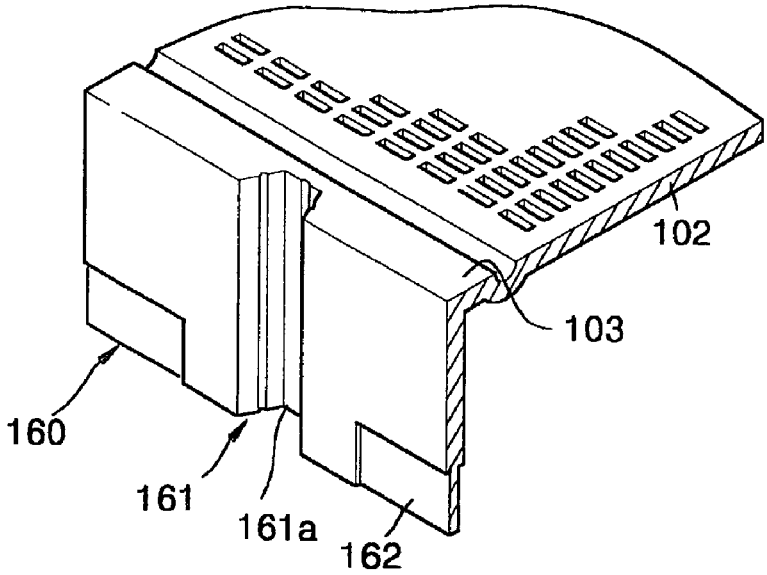
Figure 22:
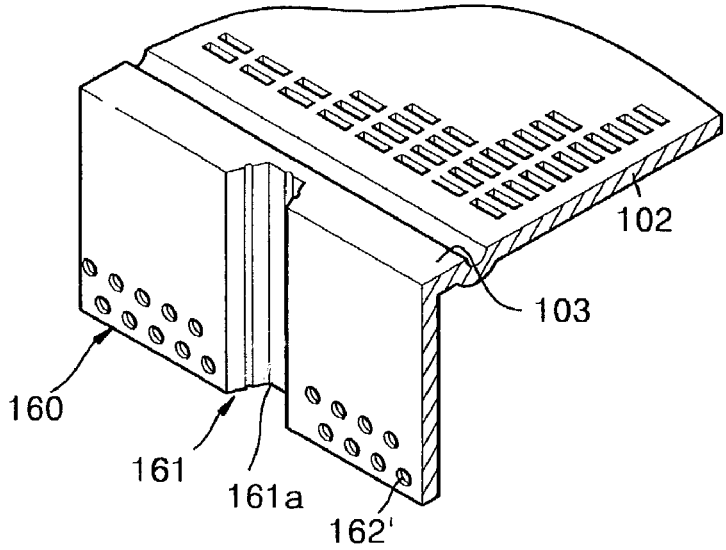

As shown in FIGS. 19 and 20, the etched portions 162 have a predetermined width and are continuous along the length of the skirt portion at the bottom end of the skirt portion. In another implementation shown in FIG. 21, the etched portions 162 do not extend continuously along the bottom end of the skirt portion 160. Alternatively, as shown in FIG. 22, etched portions 162' may be formed by etching the skirt portion 160 to a predetermined thickness in circular or polygonal shape. The welding portion formed at the middle of the skirt portion 160 has the same structure as that described above.

When molding a thin film into the shadow mask 130, the skirt portion 110 or 160 is vertically bent from the imperforate portion 103, the bending force causing a stress in the skirt portion. Due to the embossments 111 and the etched portions 120 or 162 formed in the skirt portion 110, springback forces caused by elasticity inherent in the material forming the shadow mask 130 can be prevented. The bending force causes partial constriction and tension lengthwise in the skirt portion 110 or 160, which is absorbed. Also, vibration caused by external impact can be prevented and impact resistance can be increased.

More specifically, the skirt portion 110 or 160 is weakened due to the etched portions 120 or 162 and the embossments 111. Accordingly, the skirt portion 110 or 160 is separated from the imperforate portion 103 at the border therebetween instead of being continued, and a restoring force is restrained when the skirt portion 110 or 160 is bent from the imperforate portion 103. Particularly, when the auxiliary etched portion 161*a* is formed in each embossment 111 or 161, the restoring force can also be reduced due to the embossments 111 or 161. A stress working in the lengthwise direction of the skirt portion 110 during molding is absorbed by the etched portions 120 or 162, which bend or expand.

Particularly, when forming the skirt portion 110, stress is greatest at both ends of the skirt portion 110 near the corners of the shadow mask 130. Since each of the etched portions 120 becomes thinner from the center of the skirt portion 110 to the periphery and the etched portions are wider at both ends of the skirt portion 110 than at other positions, a stress along the length of the skirt portion which is greatest at both ends of the skirt portion 110 can be satisfactorily absorbed. In addition, the etched portion 120 is manifested as the grooves 121 and 122, 123 and 124, or 125 and 126 formed on the inside and outside of the skirt portion 110, as shown in FIGS. 10, 11, 12, or 13 and is thus easily transformed by an external force. Accordingly, the stress of the skirt portion 110 can be prevented from extending to the peripheries of the imperforate portion 103 and the apertured portion 102. Where the etched portion 120 is formed in the skirt portion 110, as shown in FIGS. 10, 11, or 12, the contact area between the frame 200 and the skirt portion 110 increases, thus reducing vibration.

The stress on the skirt portion resulting from welding the skirt portion 110 to the frame is easily absorbed by the slot 141, the first and second etched portions 142 and 143 beside the slot 141, and the auxiliary etched portions 145. Thus, the stress on the skirt portion can be prevented from transforming particular portions at the periphery of the apertured portion 102 near the skirt portion 110. Particularly, the skirt portion 110 is spot-welded to the frame 200 at spots between the slot 141 and the first and second etched portions 142 and 143. Since the skirt portion 110 is not discontinued by the welding portion 140, local transformation of the particular portions can be prevented.

Figure 23:
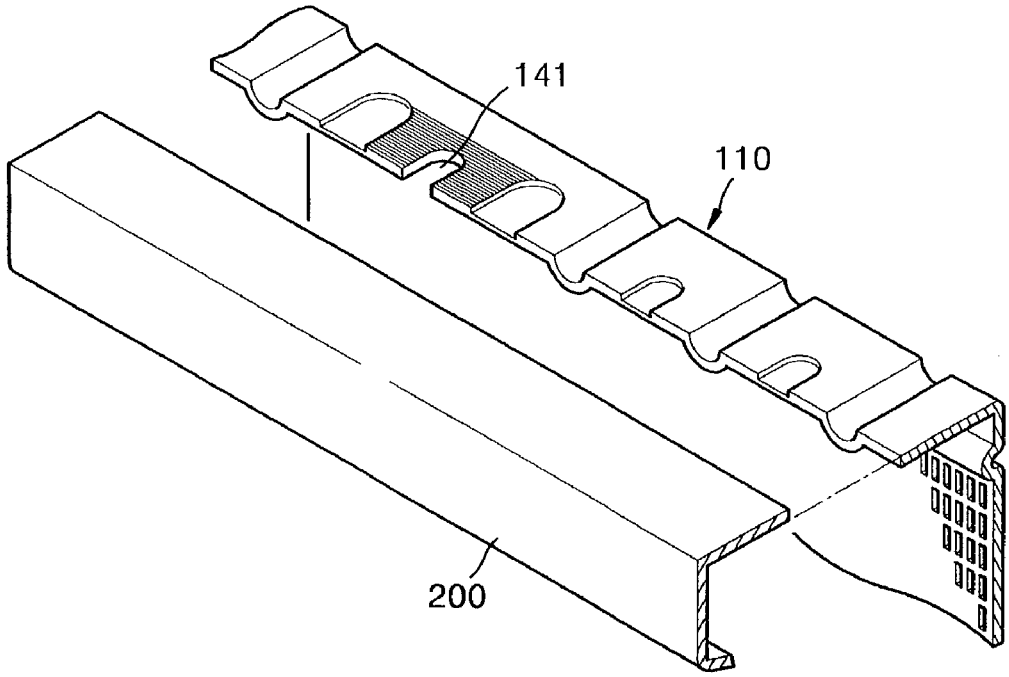
FIG. 23 is an exploded perspective view showing a skirt portion welded to a frame according to the present invention.

As shown in FIG. 23, since the skirt portion 110 continues lengthwise, the shadow mask can be more easily welded to the frame 200 and can have greater structural strength than a conventional shadow mask in which a skirt portion is discontinued due to slits.

Figure 24:
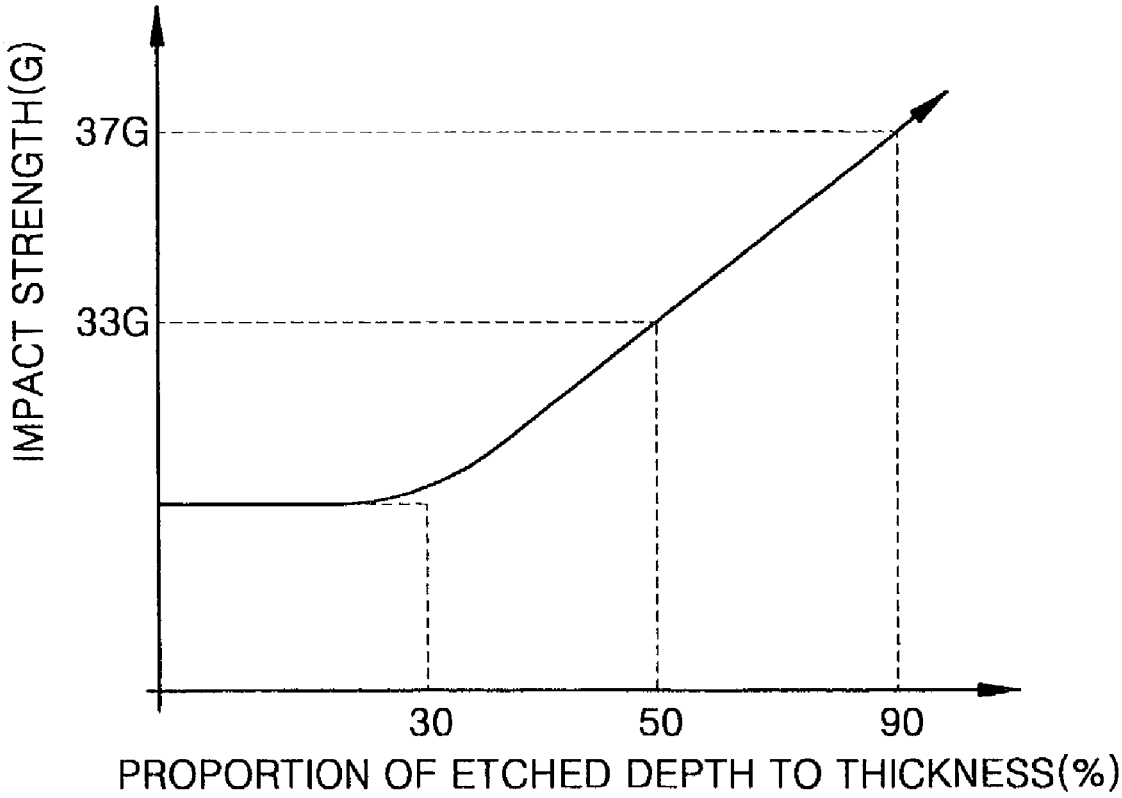
FIG. 24 is a graph showing the relationship between impact strength of a shadow mask and the etched depth of an etched portion.

Impact tests that were performed on a 17-inch color CRT using a shadow mask frame assembly according to the present invention are shown in the graph of FIG. 24.

Shadow masks used in the tests included skirt portions 110 with a thickness of 0.12 mm. The etched portions were etched to different depths of 30, 50, and 90% of the thickness of the skirt portions 110. In the graph, the X-axis indicates the proportion of an etched depth of each etched portion to the thickness of the skirt portion 110, and the Y-axis indicates the degree of impact that is expressed as the product of a force working on an object and time, i.e., F×t, in units of G and is usually used for measuring the degree of impact resistance. Greater G values indicate better impact resistance. The 17-inch color CRT used in the tests required an impact strength of at least 30 G.

As shown in FIG. 24, as the etched depth increases to more than 50% of the thickness of the skirt portion, the impact strength rapidly increases and reaches an excellent level of 37 G at 90% etched depth compared to skirt thickness.

As described above, in a shadow mask frame assembly and a color CRT having the same according to the present invention, etched portions are formed in a skirt portion of a shadow mask so that a stress, which is caused by transformation of the skirt portion during molding of the shadow mask and welding to a frame, can be prevented from misaligning an imperforate portion and an apertured portion. In addition, the structural strength and the drop impact resistance of the shadow mask is increased, and thus the shadow mask can be easily handled. Consequently, productivity can be increased.

Although a few preferred embodiments of the present invention have been shown and described, it would be appreciated by those skilled in the art that changes may be made in this these embodiments without departing from the principles and spirit of the invention, the scope of which is defined in the claims and their equivalents.

What is claimed is:

1. A shadow mask frame assembly for a cathode-ray tube, comprising:

a shadow mask comprising an apertured portion having a plurality of electron beam passage holes, an imperforate portion surrounding a periphery of the apertured portion, and a skirt portion extending from a periphery of the imperforate portion, the skirt portion and having a length in a direction of the periphery of the imperforate portion, and a plurality of etched portions etched to have a depth of a partial thickness of the skirt portion and a plurality of embossments formed in a direction of a height of the skirt portion; and a frame attached to the skirt portion.

2. The shadow mask frame assembly of claim 1, wherein the etched portions are formed by etching the inside and outside of the skirt portion.

3. The shadow mask frame assembly of claim 2, wherein each of the etched portions comprises grooves which are formed by etching the inside and outside of the skirt portion at predetermined intervals.

4. The shadow mask frame assembly of claim 3, wherein the grooves constituting each etched portion alternate on the inside and outside of the skirt portion.

5. The shadow mask frame assembly of claim 2, wherein the etched portions are formed by etching the skirt portion to a depth at or between 50 and 90% of the thickness of the skirt portion without extending through the skirt portion.

6. The shadow mask frame assembly of claim 5, wherein the etched portions have a height less than 70% of the height of the skirt portion.

7. The shadow mask frame assembly of claim 2, wherein the etched portions of the skirt portion are formed in the direction of the height of the skirt portion.

8. The shadow mask frame assembly of claim 1, wherein each of the etched portions comprises grooves which are formed by etching the inside and outside of the skirt portion at predetermined intervals.

9. The shadow mask frame assembly of claim 8, wherein the grooves constituting each etched portion alternate on the inside and outside of the skirt portion.

10. The shadow mask frame assembly of claim 1, wherein the etched portions are formed by etching the skirt portion to a depth of at or between 50 and 90% of the thickness of the skirt portion without extending through the skirt portion.

11. The shadow mask frame assembly of claim 10, wherein the etched portions have a height less than 70% of the height of the skirt portion.

12. The shadow mask frame assembly of claim 1, wherein:

the shadow mask has a quadrilateral shape defining long sides and short sides of the skirt portion, the skirt portion includes a welding portion at the middle of each long side and short side, the welding portion comprises:

a slot which is formed in the direction of the height of the skirt portion starting from the center of the bottom end of the skirt portion, and welding portion ones of the etched portions which are formed at both sides of the slot.

13. The shadow mask frame assembly of claim 12, wherein the welding portion further comprises auxiliary etched portions which are formed on at least one of the outside and inside of the skirt portion along the length of the skirt portion.

14. The shadow mask frame assembly of claim 13, further comprising half-etched portions at both ends of the long side and short side, wherein the welding portion etched portions that are formed in the welding portion and the half-etched portions are bigger than other ones of the etched portions.

15. The shadow mask frame assembly of claim 12, wherein the etched portions have an increasing etched depth when a distance from the welding portion to each etched portion increases.

16. The shadow mask frame assembly of claim 1, wherein a local etched portion is formed in at least one of the inside or the outside of each embossment formed in the skirt portion.

17. The shadow mask frame assembly of claim 16, wherein each embossment has a shape forming a part of a polygonal prism.

18. The shadow mask frame assembly of claim 16, wherein each embossment has a shape forming a part of a polygonal pyramid.

19. The shadow mask frame assembly of claim 1, wherein the etched portions of the skirt portion are formed in the direction of the height of the skirt portion.

20. The shadow mask frame assembly of claim 1 wherein, each embossment has a shape forming a part of a polygonal prism.

21. A shadow mask for a cathode-ray tube, comprising:

an apertured portion which has a plurality of electron beam passage holes;

an imperforate portion extending from a periphery of the apertured portion; and a skirt portion protruding from a periphery of the imperforate portion at long and short sides of the skirt portion and having embossments and etched portions that are formed in the skirt portion with a predetermined height of each etched portion, wherein:

the embossments and the etched portions absorb stress on the skirt portion to prevent the stress from deforming the apertured portion and the imperforate portion, and the etched portions extend into but not through the skirt portion.

22. The shadow mask of claim 21, wherein the height of the skirt portion is between 9 to 16 millimeters and the embossments have a width between 1 to 5 millimeters and a maximum height equal to the height of the skirt portion.

23. The shadow mask of claim 22, wherein the embossments have a height between 5 to 14 millimeters.

24. The shadow mask of claim 21, wherein each etched portion has a width between 3 to 15 millimeters and a height between 3 to 14 millimeters.

25. The shadow mask of claim 21, wherein the shape of each embossment defines a portion of a cylinder.

26. The shadow mask of claim 21, wherein each embossment is shaped according to an elasticity and elastic modulus of material forming the shadow mask.

27. The shadow mask of claim 21, wherein the thickness of each etched portion decreases as the etched portion is positioned closer to an end of the skirt portion.

28. The shadow mask of claim 21, wherein the etched portions continuously extend between respective pairs of the embossments along a length of the skirt portion at a bottom end of the skirt portion.

29. A shadow mask for a cathode-ray tube, comprising:

an apertured portion having a plurality of electron beam passage holes;

an imperforate portion extending from a periphery of the apertured portion; and a skirt portion extending at a generally perpendicular angle from the imperforate portion, the skirt portion comprising:

a first etched portion extending from a bottom edge of the skirt portion toward the imperforate portion, a second etched portion extending from the bottom edge of the skirt portion toward the imperforate portion, and auxiliary etched portions extending between the first etched portion and the second etched portion to define a series of grooves extending between the first etched portion and the second etched portion;

wherein the first etched portion, the second etched portion and the auxiliary etched portions reduce a transmissivity of stress on the imperforate portion and the apertured portion during welding of the skirt portion to a frame.

30. The shadow mask of claim 29, further comprising a slot centered between the first etched portion and the second etched portion extending from the bottom edge of the skirt portion toward the imperforate portion, wherein the etched portions have a thickness of at least 10% of a thickness of the skirt portion.

31. The shadow mask of claim 30, further comprising partial etched portions extending from the bottom edge of the skirt portion toward the imperforate portion and positioned further from the slot than the first etched portion and the second etched portion.

32. The shadow mask of claim 31, wherein the first etched portion and the second etched portion are wider and higher than other partial etched portions.

33. The shadow mask of claim 30, further comprising welding spots on each side of the slot and between the first etched portion and the second etched portion.

34. The shadow mask of claim 33, wherein the welding spots are positioned a height of 0.5 to 5.0 millimeters from the bottom edge of the skirt portion.

35. The shadow mask of claim 33, wherein a distance between the two welding spots is between 10 to 40 millimeters.

36. The shadow mask of claim 30, wherein a height of the slot does not exceed 50% of a height of the skirt portion.

37. A shadow mask for a cathode-ray tube, comprising:

an apertured portion having a plurality of electron beam passage holes;

an imperforate portion extending from a periphery of the apertured portion; and a skirt portion extending at a generally perpendicular angle from the imperforate portion and comprising:

a plurality of embossments formed in a direction of a height of the skirt portion; and a plurality of etched portions extending from a bottom edge of the skirt portion toward the imperforate portion, each etched portion continuously extending between a respective pair of the embossments.

38. The shadow mask of claim 37, further comprising a plurality of embossments in the skirt portion extending from the bottom edge of the skirt portion toward the imperforate portion.

* * * * *